US005655707A

United States Patent [19]

Jensen

[11] Patent Number: 5,655,707

[45] Date of Patent: Aug. 12, 1997

[54] PAPERBOARD CARTON WITH COHESIVE CLOSURE

[75] Inventor: Kurt D. Jensen, Cincinnati, Ohio

[73] Assignee: International Paper, Purchase, N.Y.

[21] Appl. No.: 655,586

[22] Filed: May 30, 1996

[51] Int. Cl.[6] ..... B65D 5/20; B65D 5/42

[52] U.S. Cl. ..... 229/160.2; 229/136; 229/247; 229/902

[58] Field of Search ..... 229/123.1, 125.42, 229/160.2, 212, 247, 248, 249, 127, 136, 137, 138, 902, 906; 383/35, 209, 210; 426/115

[56] References Cited

U.S. PATENT DOCUMENTS

| | | | |
|---|---|---|---|
| 663,133 | 12/1900 | Shipley, Jr. | 229/137 |
| 1,953,885 | 4/1934 | McAleer | 229/127 |
| 1,984,611 | 12/1934 | Weaver . | |
| 2,074,638 | 3/1937 | Black . | |
| 2,113,481 | 4/1938 | Kasdorf | 229/138 |
| 2,676,897 | 4/1954 | Trillich . | |
| 2,959,339 | 11/1960 | Sierk . | |
| 2,969,904 | 1/1961 | Cottrill | 229/248 |
| 2,970,525 | 2/1961 | Klein et al. | 229/160.2 |
| 2,986,322 | 5/1961 | Atkinson | 229/160.2 |
| 3,680,771 | 8/1972 | Blunsdon | 229/138 |
| 4,341,341 | 7/1982 | Roccaforte | 229/127 |
| 4,488,647 | 12/1984 | Davis | 383/210 |
| 4,723,700 | 2/1988 | Wischusen . | |
| 4,754,914 | 7/1988 | Wischusen . | |
| 4,890,439 | 1/1990 | Smart et al. | 53/410 |
| 5,352,466 | 10/1994 | Delonis | 383/210 |

FOREIGN PATENT DOCUMENTS

| | | | |
|---|---|---|---|
| 496974 | 10/1953 | Canada | 383/35 |
| 662521 | 9/1938 | Germany | 229/902 |
| 1822842 | 6/1993 | U.S.S.R. | 383/35 |
| 129 | 1/1897 | United Kingdom | 383/35 |

OTHER PUBLICATIONS

The wiley Encyclopedia of Packaging Technology, John Wiley & Sons (1986) p. 458.

*Primary Examiner*—Gary E. Elkins
*Attorney, Agent, or Firm*—Michael J. Doyle

[57] ABSTRACT

A carton formed from a unitary blank of paperboard, the carton exhibiting particular utility as a wrapper or container for food products, such as sandwiches. A sandwich may be formed on the wrapper before folding and forming the wrapper into a carton. Or the sandwich may be made and then placed on the wrapper blank, with two opposite ends of the blank then pulled upwardly around the sandwich. Each end is coated with a layer of cohesive material on one surface, these two surfaces being adhered together to form an upper rib of two thicknesses of paperboard, the end walls of the container then being easily manually formed. The cohesive material has the property of sticking only to itself and the coated ends are readily separated and readily reclosed. Instead of conventional adhesive materials, the use of cohesive coatings enables the coated blanks of this invention to be stacked without sticking to each other, and enables the user to close the carton for storage and subsequent use if a food product therein is not completely consumed in one sitting.

1 Claim, 2 Drawing Sheets

PAPERBOARD CARTON WITH COHESIVE CLOSURE

BACKGROUND OF THE INVENTION

This invention relates to a container and more particularly to a paperboard container fashioned from a unitary blank of paperboard.

The container is in the general shape of a parallelepiped and has an upstanding and vertically extending fin running along its length and substantially centrally thereof. While the container art is aware of such constructions, in general, no one of them exhibits the advantages of the present invention for the specific purpose of a food container.

U.S. Pat. No. 1,984,611 issued to Weaver, for example, discloses a similar carton also having an upwardly extending fin defined by two flanges at respective ends of top forming panels, but there is no means to facilitate both closure of the container for ready reopening. Further, U.S. Pat. No. 2,074,638 issued to Black also shows a somewhat similar container, but the particular means for opening and reclosing it are relatively cumbersome. It has long been recognized that ease in opening and reclosing a food carton, particularly for fast foods, is important to consumer acceptance. It is also desirable that either the cartons or blanks for forming them be readily stackable and will not stick or bind together.

SUMMARY OF THE INVENTION

According to the practice of this invention, a paperboard container is fashioned from a unitary blank which is precut and prescored to yield desired fold lines, with the top of the container being provided with a pair of upstanding flanges which are in at least partial surface contact with each other and which form a rib running from one end of the container to the other. The mating and interior surfaces of these flanges are each provided with a cohesive material. A cohesive material has the property that after being applied in wet form to a substrate and dries, it will not stick to most surfaces other than a similiar cohesive surface. In operation, a food item, such as a sandwich, may be formed directly on the blank, or may be formed at another location and placed on the blank. The side walls of a container are then moved to an upright position, and the two upper flanges are secured together by virtue of the cohesive material on each. Then, the end closure panels are folded in place to thereby close the carton. When the user desires to obtain access, such as to obtain access to a fast food item, it is only necessary to separate the upstanding flanges from each other by peeling them apart in opposite directions. Further, if the food item is not completely consumed, it may be replaced in the container and the container resealed by pushing the cohesive areas together again. In order to facilitate separation of the two upstanding flanges, each flange is provided with a free edge, and each free edge has a protruding ear extending away from its respective flange. These ears are laterally displaced from each other in the container assembled configuration. To even further simplify separation of the flanges, the free edge of each flange, adjacent its respective ear, is provided with a depression. When the container is closed, a depression on one flange is aligned with an ear on the other flange, so as to facilitate pushing the ears apart in opposite directions to open the container.

DETAILED DESCRIPTION OF THE INVENTION

Figure 1:
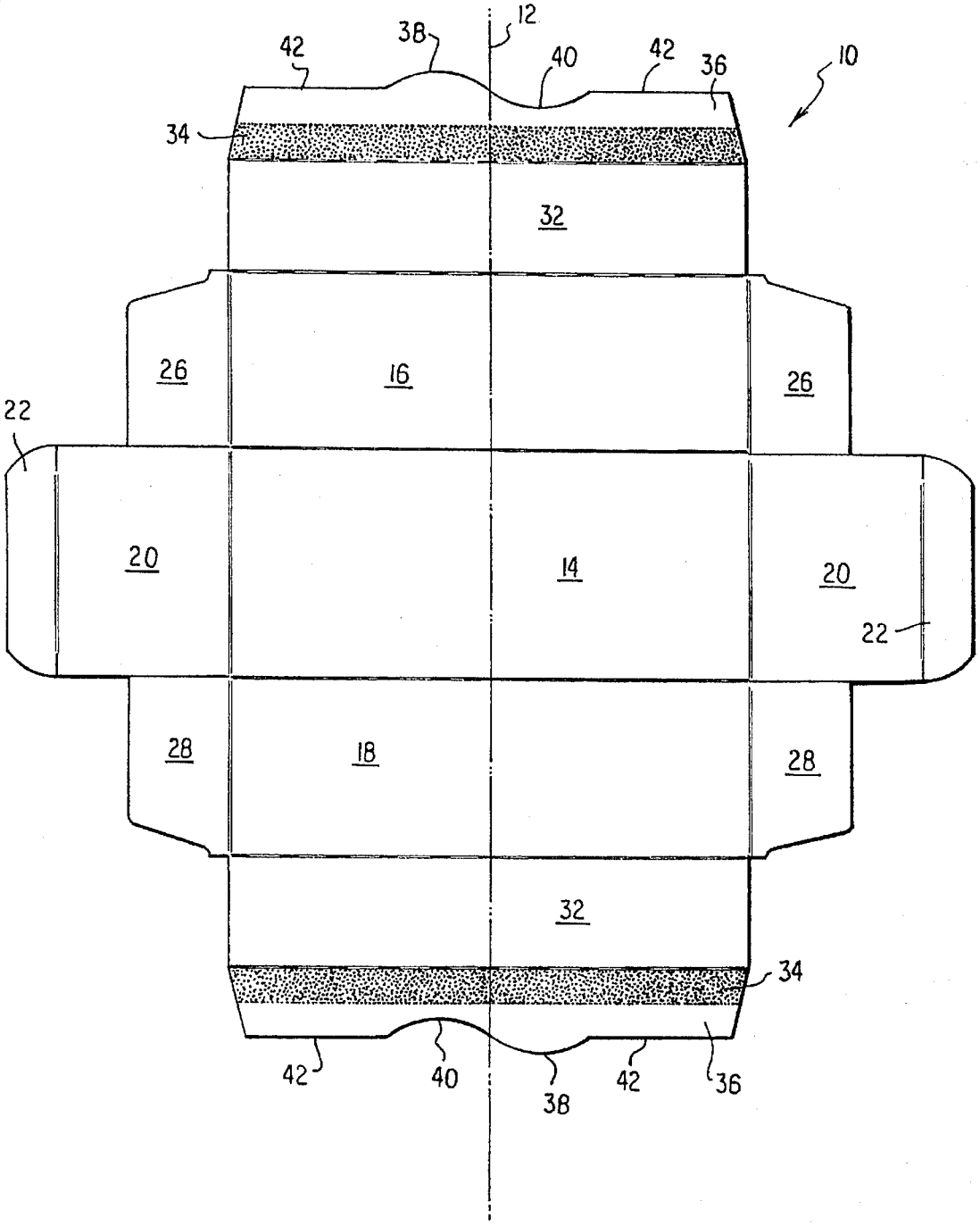
FIG. 1 is a plan view of a unitary blank of paperboard or other stiff, foldable and resilient sheet material from which the container of this invention is formed.

Referring now to FIG. 1, a unitary blank of paperboard is indicated generally by 10, and includes a bottom panel 14, a first side wall forming panel 16, a second side wall forming panel 18, and end wall forming panels 20. Each of the latter is provided with a flap 22. Corner forming panels 26 and 28 are at the ends of respective panels 16 and 18. Each side panel 16 and 18 is provided with a respective top flap or panels 32, with each of the latter provided with a respective flange 36, each flange 36 carries a layer or coating 34 of cohesive material. Each flange 36 has a free edge having portions 42, 38, 40, 42. It will observed that portion 38 is an ear which projects away from flange 36 while portion 40 is a concavity or depression which extends toward its respective flange 36. Blank 10 has a longitudinal axis 12 which, except for free edge portions 38 and 40, is mirror symmetrical. Flaps 22, end wall panels 20, and bottom panel 14 define a group of horizontally aligned panels. Also, flanges 36, top flaps 32, side panels 16, 18, and bottom panel 14 define a group of vertically aligned panels, these two groups forming a generally cross shaped blank.

Figure 2:
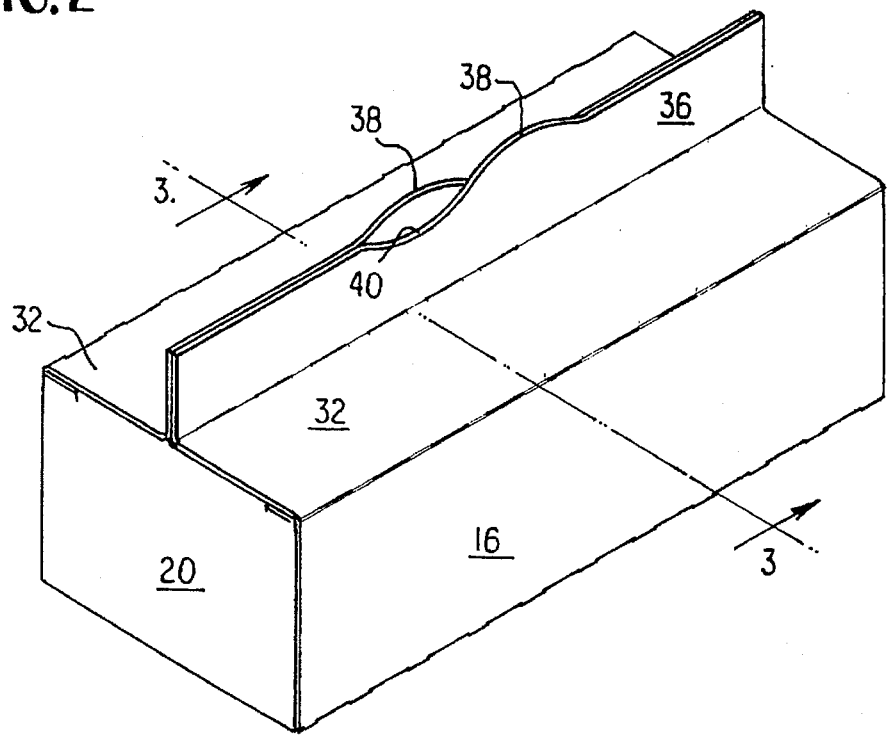
FIG. 2 is a partial perspective view of the upper portion of the closed container formed by folding the blank of FIG. 1 along the indicated fold lines.
Figure 3:
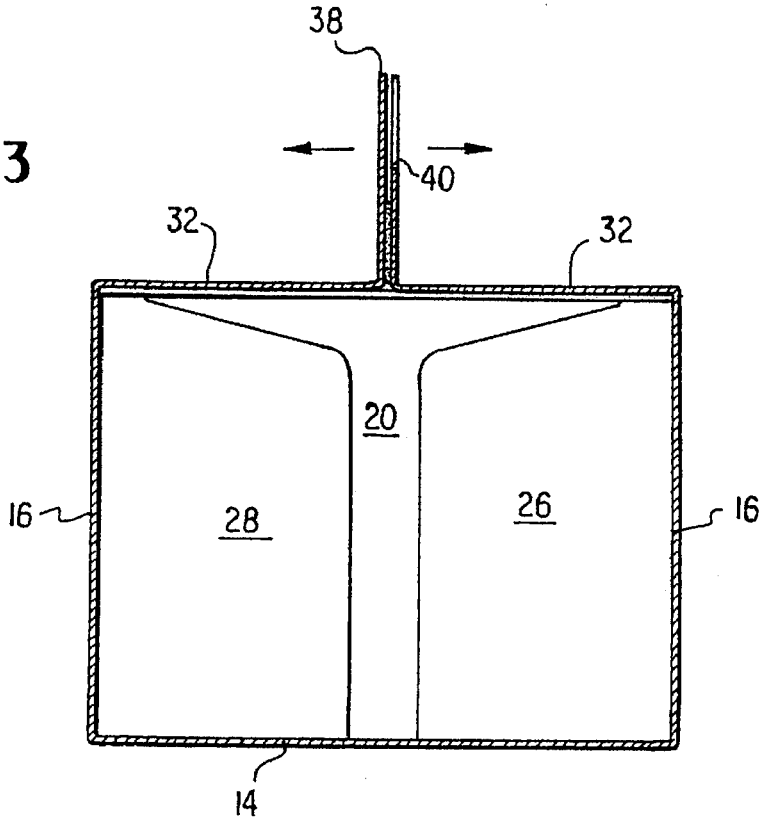
FIG. 3 is a view taken along section 3—3 of FIG. 2.

Referring now to FIG. 2, the blank of FIG. 1 has been folded about the indicated score or fold lines, and, firstly, flanges 36 are placed together so that they are vertical and form a double thickness fin, with cohesive portions 34 of each being in surface contact with each other. After this step, the end forming closure panels 20, 22, 26, and 28 are manually folded inwardly by the packager to close the ends of the carton. FIGS. 2 and 3 both show that an ear 38 of a first flange 36 is opposite to a corresponding depression 40 of the other or second flange 36. FIG. 3 also shows corner forming panels 28 as being folded and lying against the interior portions of end panels 20. As indicated by the oppositely directed arrows of FIG. 3, opening of the top portion of the container shown at FIG. 2 is effected by peeling the flanges apart in opposite directions. Thus, at FIG. 2, the leftmost ear 38 may be pushed in a left and upper direction, while the right-hand ear 38 is pushed to a right and downward direction.

After the container is opened, its contents may be obtained and, if only partially consumed, the uneaten portion may be replaced and flanges 36 resealed by placing the cohesive areas in contact again.

From a consideration of FIG. 1, it is easily seen that the cohesively coated flat blanks 10 may be vertically stacked (coated surfaces facing upwardly or downwardly) for sequential use by the packager so that the cohesive areas touch only non cohesively coated areas. No sticking between adjacent blanks will occur however due to the above described nature of the cohesive material. A typical cohesive material (being a water based cold seal adhesive) is sold by Findley Co. of Wisconsin under the (trade mark) Nipweld.

While the free edges of flanges 36 are shown as curved so as to form an ear, they may be straight or of variable design profiles.

I claim:

1. A unitary paperboard blank for forming a closed container, said blank being generally cross shaped and including a central bottom panel, said central bottom panel having a width, two side panels each foldably secured to two opposite respective edges of said bottom panel, a top panel attached to each respective said side panel, each said top panel having a width substantially one-half of that of said bottom panel, each said top panel having a respective flange panel foldably secured to a respective said top panel, each said flange panel having a width, each said flange panel having a free edge, each said flange panel having a layer of cohesive material at least partially thereon, two end wall panels foldably secured to two respective opposite edges of said bottom panel, each said end panel foldably carrying a flap, each said side panel having an end, each said side panel end foldably carrying a corner panel, said bottom panel and said end panels and said end panel flaps forming a group of horizontally aligned panels, said bottom panel and said side panels and said top panels and said flanges also being aligned and forming a group of vertically aligned panels, said two groups of aligned panels forming a generally cross shaped blank.

* * * * *